US008135319B2

(12) United States Patent
Fujita

(10) Patent No.: US 8,135,319 B2
(45) Date of Patent: Mar. 13, 2012

(54) TRANSFERER AND IMAGE FORMING APPARATUS HAVING A GUIDE MEMBER INCLUDING A COMB-LIKE STRUCTURE

(75) Inventor: Junpei Fujita, Sagamihara (JP)

(73) Assignee: Ricoh Company Limited, Tokyo (JP)

( * ) Notice: Subject to any disclaimer, the term of this patent is extended or adjusted under 35 U.S.C. 154(b) by 370 days.

(21) Appl. No.: 12/427,377

(22) Filed: Apr. 21, 2009

(65) Prior Publication Data

US 2009/0279927 A1 Nov. 12, 2009

(30) Foreign Application Priority Data

May 8, 2008 (JP) ..... 2008-122482

(51) Int. Cl.
*G03G 15/16* (2006.01)

(52) U.S. Cl. ..... 399/316; 399/361

(58) Field of Classification Search ..... 399/316, 399/361

See application file for complete search history.

(56) References Cited

U.S. PATENT DOCUMENTS

| | | | | |
|---|---|---|---|---|
| 4,052,150 | A * | 10/1977 | Behun | 432/60 |
| 5,090,682 | A * | 2/1992 | Takimoto | 271/225 |
| 5,221,952 | A * | 6/1993 | Ishii et al. | 399/315 |
| 5,870,661 | A * | 2/1999 | Menzel et al. | 399/400 |
| 6,493,534 | B2 * | 12/2002 | Sawanaka et al. | 399/316 |
| 2005/0206073 | A1 * | 9/2005 | Fukushima | 271/226 |
| 2005/0207802 | A1 * | 9/2005 | Izumi et al. | 399/316 |
| 2007/0104502 | A1 | 5/2007 | Ogihara et al. | |
| 2008/0150222 | A1 * | 6/2008 | Nakakita et al. | 271/226 |
| 2008/0265488 | A1 * | 10/2008 | Hiura et al. | 271/110 |
| 2010/0129121 | A1 * | 5/2010 | Ichikawa et al. | 399/316 |

FOREIGN PATENT DOCUMENTS

| | | | |
|---|---|---|---|
| JP | 05316289 | A * | 11/1993 |
| JP | 9-188439 | | 7/1997 |
| JP | 11-72972 | | 3/1999 |
| JP | 3444778 | | 6/2003 |
| JP | 2007-292904 | | 11/2007 |

* cited by examiner

*Primary Examiner* — David Gray

*Assistant Examiner* — G. M. Hyder

(74) *Attorney, Agent, or Firm* — Oblon, Spivak, McClelland, Maier & Neustadt, L.L.P.

(57) ABSTRACT

A transferer, including a guide member having a plate-shaped guide face and leading a transfer material after a toner is transferred thereonto, wherein the guide member has an edge pointing to the feeding direction of the transfer material and having plural comb-like structures perpendicular to the feeding direction thereof.

14 Claims, 11 Drawing Sheets

TRANSFERER AND IMAGE FORMING APPARATUS HAVING A GUIDE MEMBER INCLUDING A COMB-LIKE STRUCTURE

BACKGROUND OF THE INVENTION

1. Field of the Invention

The present invention relates to a transferer and an image forming apparatus, and more particularly to prevention of backside contamination of transfer materials after toner images are transferred onto the transfer materials.

2. Discussion of the Background

As commonly known, in image forming apparatuses such as copiers, facsimiles and printers, an electrostatic latent image formed on a photoreceptor as an image bearer is visualized with a developer fed from an image developer.

The visualized toner image is melted, penetrated and fixed on a transfer material to form a duplicate image thereon by a fixer upon application of heat and pressure after transferred onto a transfer material.

The duplicate image includes not only single-colored images such as monochrome images, but also multi-colored images including full-color images.

As image forming apparatuses for forming multi-colored images, particularly full-color images, tandem image forming apparatuses including image forming stations for each color located along an intermediate transfer belt as a first transferer in parallel, onto which images formed by the image forming stations are sequentially transferred are known.

The sequentially-transferred and overlapped images on the intermediate transfer belt are transferred by a second transferer onto a transfer material at a time, and the transfer material is transferred to a fixer.

Japanese published unexamined application No. 2007-292904 discloses a tandem image forming apparatus feeding the transfer material after the second transfer to a fixer with a feeding guide in a route from the second transfer site to the fixer.

A toner remaining on the background of the intermediate transfer belt occasionally transfers and adheres to the surface of a roller used as a member performing the second transfer. The toner adhering to the surface of the roller causes backside contamination of the transfer material. When the transfer material and the intermediate transfer belt are cleaned, the toner is occasionally discharged to easily clean them. However, some low-cost image forming apparatuses do not have such system and a toner inevitably adheres to the second transferer in many cases.

The toner adhering to the backside of a transfer material occasionally transfers to a guide face of the feeding guide located in the route to the fixer in the process of traveling thereto. A toner is occasionally peeled off when scraped by the guide face and does not adhere thereto. However, a toner is dragged thereby and occasionally stays at an edge face thereof toward the fixer.

When the toner accumulates too much at an edge face, a transfer material contacts the toner and the backside thereof is possibly contaminated.

In order to prevent the backside contamination of a transfer material caused by a toner accumulating near the edge of the feeding guide, Japanese published unexamined application No. 09-188439 discloses a feeding guide having a guide face including a rib having a height capable of forming a step as a space accumulating a toner at the edge. This avoids a contact between the toner and the transfer material by feeding the transfer material while floating the transfer material such that the end thereof does not enter the step, taking advantage of its stiffness.

In order to avoid a contact between the transfer material and the feeding guide, Japanese patent No. 3444778 discloses a feeding guide having a guide face including a back-and-forth movable swinging member, feeding a transfer material while setting the transfer material apart from the guide face. Alternatively, Japanese published unexamined application No. 11-172972 discloses a feeding guide having a spur floating a transfer material.

In order to prevent the backside contamination of a transfer material, as disclosed in Japanese published unexamined application No. 09-188439, a step is formed between a rib formed on the guide face and the guide face such that the transfer material is difficult to contact a toner accumulated in the step by a property of the transfer material itself, which is different from application of an outer force. This possibly cannot be expected to prevent the backside contamination without fail. Before explaining the reason, a generating mechanism of the backside contamination will be explained.

In FIG. 12A, a toner T adhering to a second transfer roller A transfers to the backside of a transfer paper S as a transfer material passing the second transfer position, and adheres thereto.

In FIG. 12B, when the transfer paper S travels along the guide face of a transfer exit-side guide member B, the toner adhering to the backside of a transfer paper S is dragged by a friction force between the transfer paper S and the guide face. When the transfer paper S reaches the edge of the guide member B, the toner T is not dragged thereby and accumulates at the edge as shown in an enlarged view in FIG. 12B. As a result, when the toner accumulates too much at an edge face, a transfer material contacts the toner and the backside thereof is possibly contaminated.

In Japanese published unexamined application No. 09-188439, a rib is used as a catapult for floating the edge of a transfer material just not to lead the end of the transfer material in the step as little as possible. Therefore, depending on the stiffness, i.e., elasticity or the weight of the transfer material, the transfer material possibly travels toward the step or a posterior portion thereof possibly contacts to an edge of the step when bending toward the guide face. There still is a possibility that a transfer material contacts a toner accumulating on the step and the backside thereof is contaminated.

The present inventor made an experiment based on Japanese published unexamined application No. 09-188439 only to find that the backside of a transfer material is still contaminated.

As shown in FIG. 13A, a step is formed with a rib on a guide face of the transfer exit-side guide and an experiment was made under the following conditions to see generation of the backside contamination.

(1) Fifty both-sided images having a high image area were produced to contaminate the guide.

(2) One hundred one-sided images were produced to count the backside contamination.

(3) A transparent adhesive tape was put on the whole guide to see whether a toner stays on a guide plate.

As a result, 48 out of 100 images had backside contamination. The transparent adhesive tape was contaminated with a toner. A shown in FIG. 13B, a position having a backside contamination was just shifted and did not disappear, and the backside contamination having the shape of a horizontal stripe remained.

With only a feeding guide having a guide face including a step in a feeding route for a transfer material, a toner cannot be expected to naturally fall from the step by gravity because the step does not have a vertical face and is likely to accumulate therein. Therefore, the accumulated toner is likely to contact a transfer material.

Because of these reasons, a need exists for a transferer reliably preventing the backside contamination of a transfer material.

SUMMARY OF THE INVENTION

Accordingly, an object of the present invention is to provide a transferer reliably preventing the backside contamination of a transfer material.

Another object of the present invention is to provide an image forming apparatus using the transferer.

These objects and other objects of the present invention, either individually or collectively, have been satisfied by the discovery of a transferee, comprising a guide member having a plate-shaped guide face, configured to lead a transfer material after a toner is transferred thereonto, wherein the guide member has an edge pointing to the feeding direction of the transfer material and having plural comb-like structures perpendicular to the feeding direction thereof.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a transferee reliably preventing the backside contamination of a transfer material. More particularly, the present invention relates to a transferer, comprising a guide member having a plate-shaped guide face, configured to lead a transfer material after a toner is transferred thereonto, wherein the guide member has an edge pointing to the feeding direction of the transfer material and having plural comb-like structures perpendicular to the feeding direction thereof.

In the present invention, a plate-shaped guide member having a comb-like edge pointing to the feeding direction of the transfer material has less contact area therewith such that a toner accumulating on the guide member has less opportunity to adhere thereto.

Particularly, different from a rectangle, the comb-like edge is thinner toward the feeding direction of the transfer material and the toner and the transfer material contact less each other. Further, the toner accumulating on the guide member is collectable with an electroconductive member or a slit structure to prevent the backside contamination of a transfer material.

In the present invention, since the guide member has a guide face having an electrical low resistivity sheet, even if the guide face (sheet) is frictionally charged by friction between the guide member and the transfer material, the guide face is instantly discharged, which prevents repulsion of a frictionally-charged toner and scattering thereof.

In the present invention, the fixer has a fixing nip located above the other side of an intermediate transfer member from the transfer position in the vertical feeding direction of the transfer material. Therefore, first, the transfer speed of a transfer material is adjusted to always have a loose between he transfer nip and the fixing nip toward the guide member. Secondly, the loose is held by a transfer exit-side guide member such that a transfer material is always fed along the guide.

Consequently, it can prevent a transfer material from having a wrinkle at the fixing nip and distorted images (abnormal images such as wrinkled images) from being produced.

Hereinafter, a best embodiment of the present invention will be explained.

Figure 1:
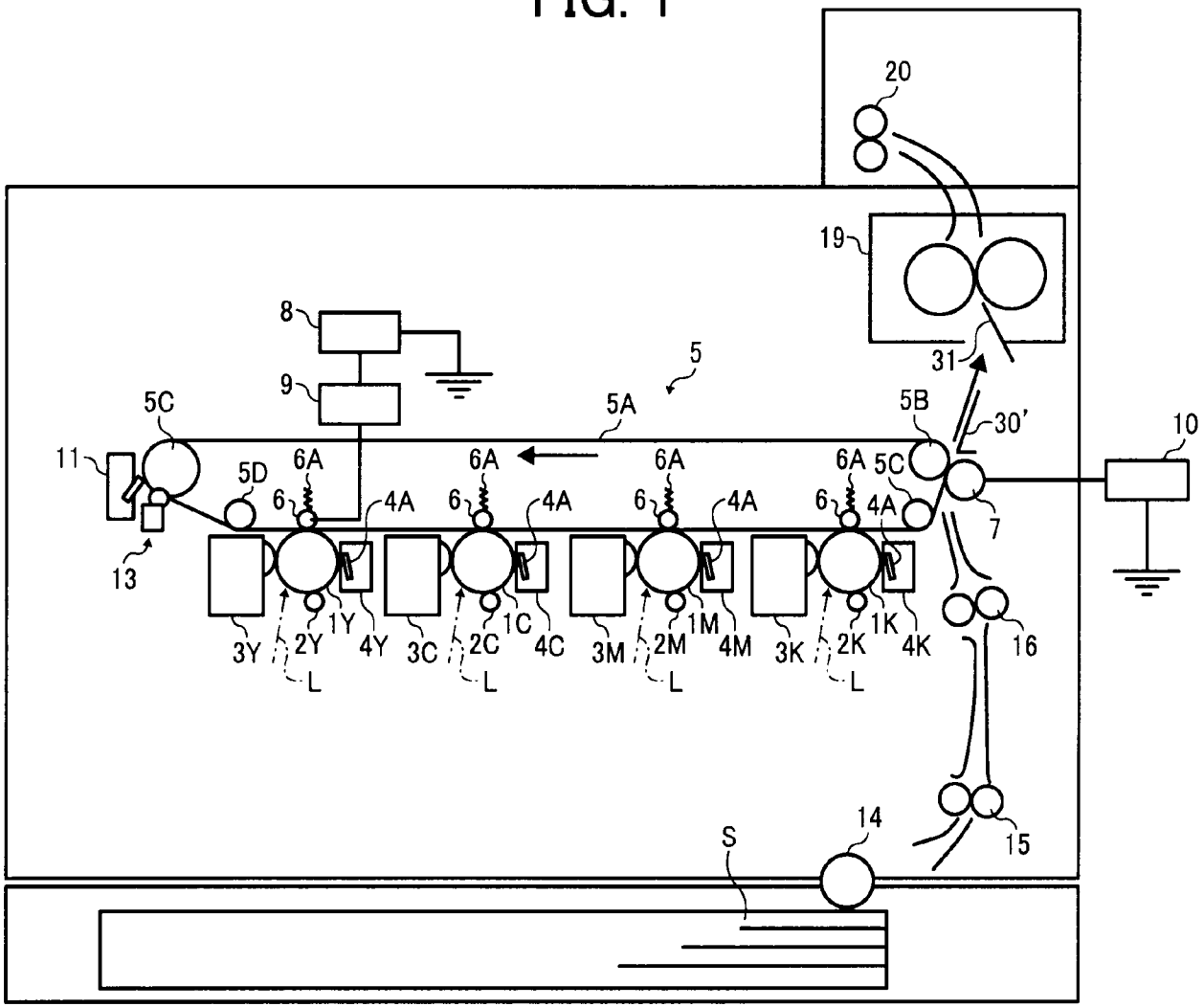
FIG. 1 is a schematic view for explaining the constitution of an image forming apparatus using the transferer of the present invention.

FIG. 1 is a schematic view illustrating an image forming apparatus using the transferer of the present invention, which is a tandem color printer.

In FIG. 1, the image forming apparatuses includes image forming stations for each color located along an intermediate transfer belt 100 as an intermediate transferer in parallel (expediently, image forming stations and process cartridges mentioned later for each color, i.e., yellow, magenta, cyan and black will be represented by symbols Y, M, C and K).

Each of the image forming stations has a process cartridge having the same constitution, i.e., a photoreceptor drum 1, and a charger 2, an image developer 3 and a cleaner 4 (each has each color symbol) located around the photoreceptor drum 1.

In the process cartridge, the photoreceptor drum is uniformly charged by the charger 2, and an electrostatic latent image is formed thereon by writing performance of a writer (expediently, only a light route L is shown).

The electrostatic latent image formed on the photoreceptor drum 1 is visualized with a toner fed from the image developer 3 and first transferred onto an intermediate transfer belt 5A as a visual image bearer at a transferee 5 mentioned later upon receipt of a transfer bias from a transfer roller 6 as a first transferer.

When a full-color image is formed, the visual images formed by each image forming station are sequentially transferred onto the intermediate transfer belt 5A and overlapped thereon.

A toner remaining on the photoreceptor drum 1 is removed by a cleaning blade 4A of the cleaner 4 after the visual image is transferred, and is charged by the charger 2 to be prepared for forming a following image.

The transferer 5 includes the intermediate transfer belt 5A suspended by and wound around plural rollers 5B, 5C, 5D and 5E and a first transfer roller 6 facing each photoreceptor drum sandwiching the intermediate transfer belt 5A.

The intermediate transfer belt 5A in FIG. 1 travels at a process speed of 150 mm/sec in the direction indicated by an arrow by a drive roller which is one of the plural rollers.

Figure 2:
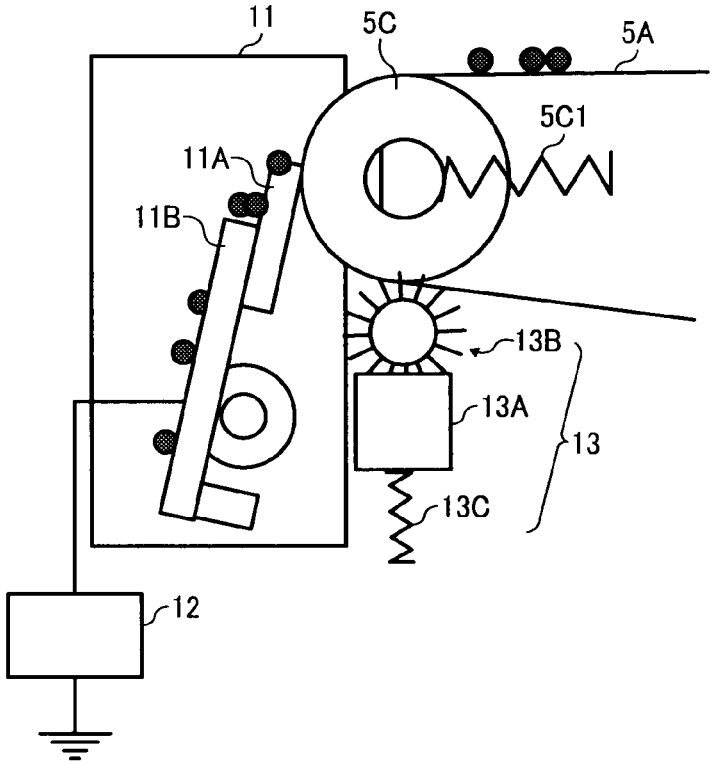
FIG. 2 is a schematic view for explaining the constitution of a belt cleaner for use in the image forming apparatus in FIG. 1.

The roller 5B is used as the drive roller and a backup roller for a second transfer roller 7 as a second transferer facing the roller 5B sandwiching the intermediate transfer belt 5A as well. The roller 5C is used as a tension roller biased by an elastic material 5C such as a spring shown in FIG. 2.

The transfer roller 6 as the first transferer is biased toward the photoreceptor drum 1 by an elastic material 6A such as a spring, and transfers a visual image onto the intermediate transfer belt 5A with a transfer bias from a bias electric source and a bias control circuit. The first transfer bias is +1,800 V in FIG. 1. A second transfer bias is applied to the second transfer roller 7 from a bias electric source 10. The constitution of the second transfer roller 7 will be explained later.

The intermediate transfer belt 5A is formed of a single or plural layers of PVDF (polyvinylidene fluoride), ETFE (ethylenetetrafluoroethylene copolymer), PI (polyimide), PC (polycarbonate), etc., and an electroconductive material such as carbon black is dispersed therein to have a volume resistivity of from $10^6$ to $10^{12}\Omega\cdot$cm and a surface resistivity of from $10^9$ to $10^{13}\Omega\cdot$cm. The intermediate transfer belt 5A may have a release layer on its surface when necessary. Specific examples of materials for forming the release layer include, but are not limited to, fluorine-containing resins such as ETFE (ethylenetetrafluoroethylene copolymer), PTFE (polytetrafluoroethylene), PVDF (polyvinylidene fluoride), PFA (perfluoroalkoxy), FEP (tetrafluoroethylene/hexafluoropropylene copolymer) and PVF (polyvinylfluoride).

The intermediate transfer belt 5A is formed by an injection method or a centrifugal molding method, and the surface thereof may be grinded when necessary.

A toner remaining on the intermediate transfer belt 5A is removed after all the second transfers are completed. A belt cleaner 11 in FIG. 2 has a cleaning blade 11A formed of an elastic material such as a urethane rubber contacting the intermediate transfer belt 5A. The cleaning blade 11A is contactably and separably held by a swingable blade holder 11B.

A power feeding route from a voltage applicator 12 is connected to the blade holder 11B to drop a toner adhering thereto.

A lubricant applicator 13 is located near the belt cleaner 11 to prevent the intermediate transfer belt 5A from being frictionally damaged and to improve toner removability.

The lubricant applicator 13 has a solid lubricant 13A and a application brush 13B which rotates while contacting the solid lubricant 13A to scrape the lubricant 13A and applies the lubricant 13A to the surface of the intermediate transfer belt 5A.

The solid lubricant 13A is formed of a metal salt of fatty acid having a straight-chain hydrocarbon structure.

The lubricant 13A is applied to the surface of the intermediate transfer belt 5A in the form of a powder by degrees, and specific examples of methods of applying the lubricant include the method of scraping a solidified lubricant in the shape of a block with a lubricant application means such as the application brush 13B or a method of externally adding the lubricant 13A to a toner.

The solidified lubricant is pressed to the application brush 13B at 1 to 4 N by a lubricant presser 13C which is an elastic material as a spring to scrape the lubricant 13A with the application brush 13B.

The second transfer roller 7 is formed of a core metal such as SUS coated with an elastic material such as urethane having a resistivity of from $10^6$ to $10^{10}\Omega$.

The second transfer roller 7 is driven by a drive gear (not shown) and has a peripheral speed almost equivalent to a traveling speed of the intermediate transfer belt 5A. The second transfer is controlled by a constant current, and which is +30 μA in this embodiment.

A transfer paper S is fed by a paper feeding roller 14, a transfer paper conveyor roller 15 and a registration roller 16 just when the end of an overlapped four-color image formed on the intermediate transfer belt 5A reaches the second transfer position.

The transfer paper S on which the overlapped four-color image is transferred is conveyed to a fixer 19 along an exit-side guide member 30' and a fixing entrance-side guide member 31, where the overlapped four-color image is fixed on the transfer paper S, and is discharged by a paper discharge roller 20. The transfer paper S may be discharged after an image is transferred thereon so as to drop a toner adhering to the backside thereof.

A toner for use in the present invention is preferably prepared by a polymerization method.

Further, the toner for use in the present invention preferably has shape factors SF-1 and SF-2, of from 100 to 180 and 100 to 180, respectively.

In addition, the toner preferably has a volume-average particle diameter of from 4 to 10 μm. A toner having a volume-average particle diameter of 6.5 μm is used in the present invention.

Figure 3:
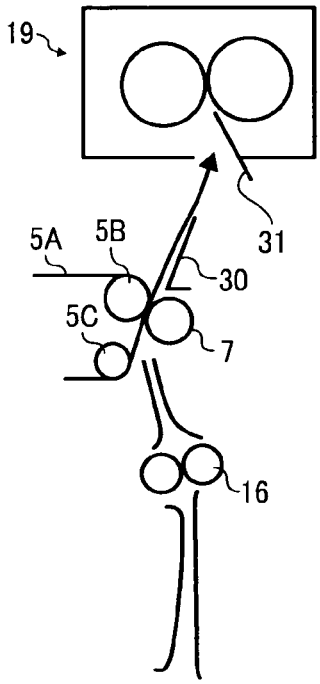
FIG. 3 is a schematic view illustrating devices installed from the transfer to fixing positions in the image forming apparatus in FIG. 1.

The image forming apparatus of this embodiment has a vertical conveying route of a transfer paper S from the second transfer position to the fixer 19. FIG. 3 is a schematic view illustrating a constitution of the conveying route from the second transfer position to the fixer 19.

In FIG. 3, a transfer paper let out from the registration roller 16 vertically passes a transfer nip formed of the drive roller 5B of the intermediate transfer belt and the second transfer roller 7, the second transfer position, the exit-side guide member 30, the fixing entrance-side guide member 31 and reaches the fixer 19.

FIGS. 5A, 5B, 5C and 5D are schematic views for explaining a feeder for use in the transferee of the present invention.

The exit-side guide member 30' has a guide face 30B having an edge pointing to the feeding direction of a transfer material and having plural comb-like structures 30A' perpendicular to the feeding direction. The exit-side guide member 30' is preferably formed of an ABS resin, etc.

The comb-like structure 30A' is thinner toward the feeding direction of a transfer material. Such shapes include a pyramidal, a saw-like or a triangle shape except for a rectangle. The edge thereof may have an acute-angle or a rounded waveform. The plural comb-like structures 30A' preferably have intervals not greater than 40 mm. When greater than 40 mm, the end of a transfer material occasionally bends between the plural comb-like structures 30A' and is likely to contact the end of the exit-side guide member 30', i.e., a toner accumulating thereon.

The edge face of the exit-side guide member 30' has a small area and gaps are formed between the comb-like structures. Therefore, a toner accumulates less at the edge of the exit-side guide member 30'. In addition, the gaps between the comb-like structures increase opportunities for a toner to fall and reduce the amount of a toner accumulating at the edge. Consequently, transfer of the accumulated toner onto the backside of a transfer paper is reduced.

Figure 5A:
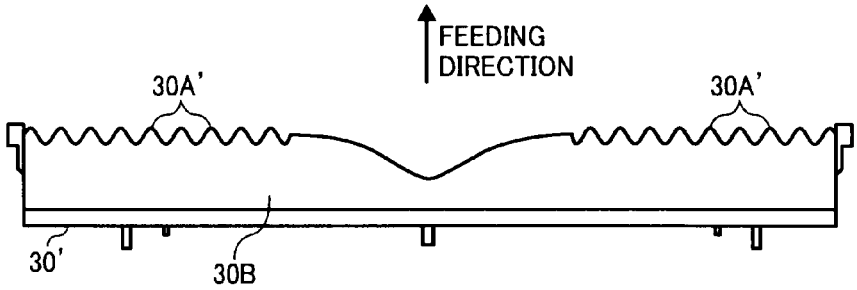
FIGS. 5A, 5B, 5C and 5D are schematic views for explaining a feeder for use in the transferee of the present invention.
Figure 5B:
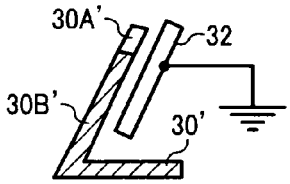

As shown in FIG. 5B, an earthed electroconductive member 32 facing the comb-like structure 30A' may be formed therebehind to collect a toner accumulating thereat.

Figure 5C:
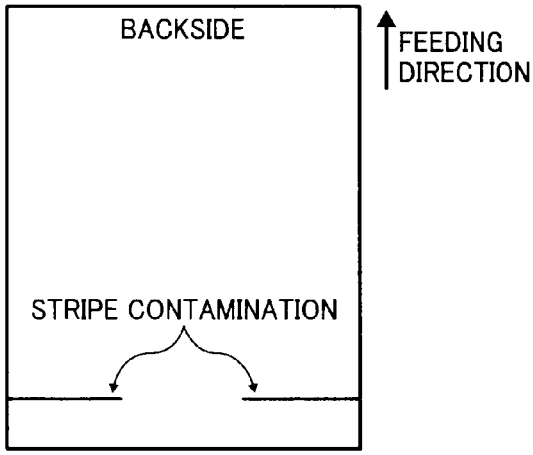
Figure 5D:
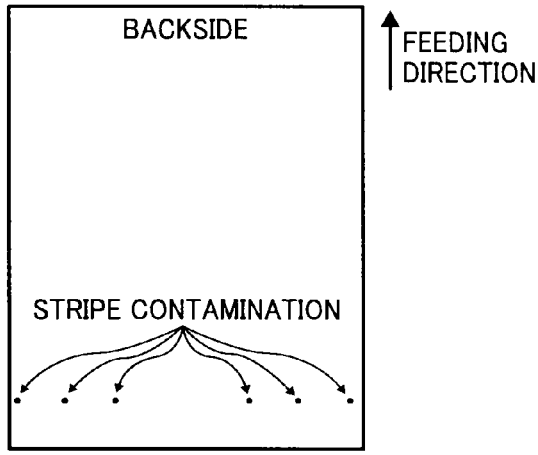

FIGS. 5C and 5D are experimental results of the backside contamination with a conventional technology and the present invention.

FIG. 5C is a result of the backside contamination with a conventional technology. A toner accumulating much on the edge face of the exit-side guide member 30' adheres to the backside of a transfer material in the shape of a horizontal stripe perpendicular to the feeding direction of the transfer material.

FIG. 5D is a result of the backside contamination with the present invention. A toner accumulating less on the edge face of the exit-side guide member 30' and adheres to the backside of a transfer material as dots, but they are almost invisible.

In this embodiment, since a toner accumulating at the edge of the exit-side guide member 30' can be reduced, the toner falls less when a transfer material passes the second transfer position and the end thereof hits the exit-side guide member 30'. Therefore, the transfer material has less backside contamination.

In this embodiment in FIGS. 6A, 6B, 7A and 7B, the exit-side guide member 30' has a guide face 30B' facing a transfer material and including plural slits 30C' (FIGS. 6A and 6B), and further an electroconductive member 32 is formed (FIGS. 7A and 7B) for the slits 30C' and the comb-like structure 30A'.

In this embodiment, a toner adhering to the backside of a transfer material traveling along the guide face 30B' is likely to fall when facing the slit 30C' and the toner is less dragged toward the edge of the exit-side guide member 30'. Therefore, the toner less accumulates at the edge, which prevents the backside contamination of a transfer material.

Figure 6A:
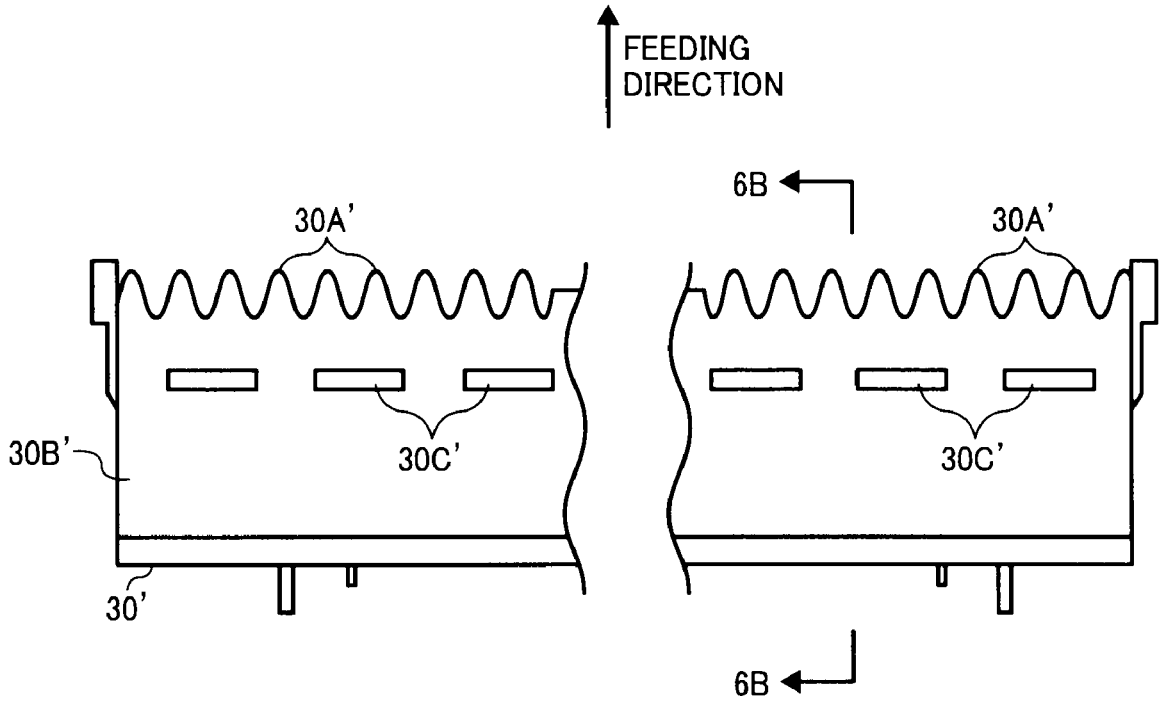
FIGS. 6A and 6B are schematic views illustrating another embodiment of the feeder in FIGS. 5A, 5B, 5C and 5D.
Figure 6B:
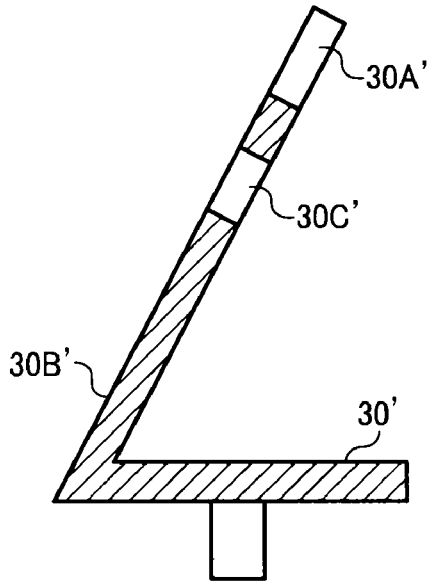
Figure 7A:
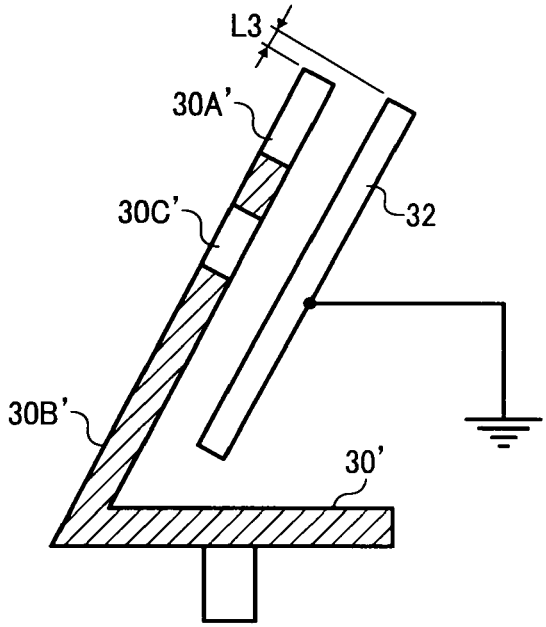
FIGS. 7A and 7B are schematic views illustrating a further embodiment of the feeder in FIGS. 5A, 5B, 5C and 5D.
Figure 7B:
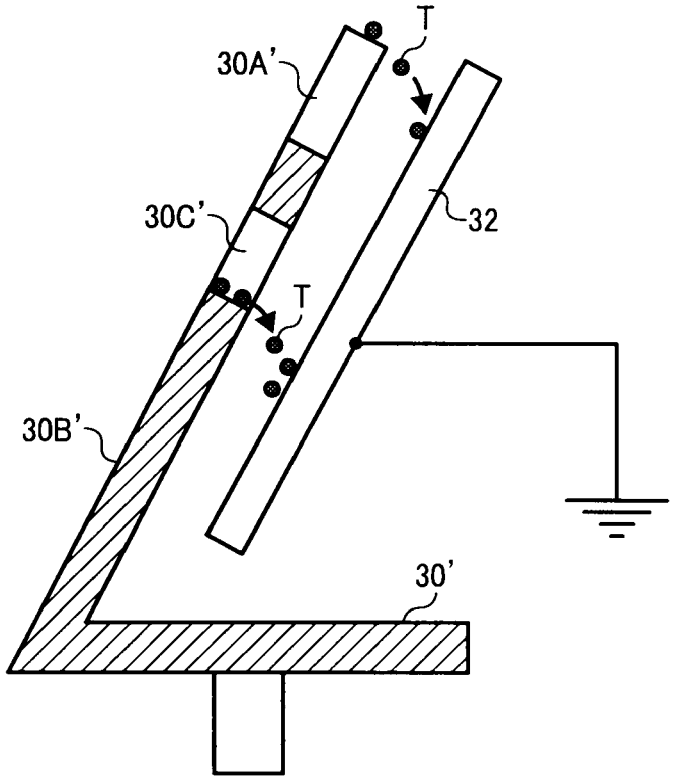

FIGS. 7A and 7B are a combination of the electroconductive member in FIG. 5B and the exit-side guide member 30' in FIGS. 6A and 6B. An electroconductive member 32 is formed behind the exit-side guide member 30' having the guide face 30B' including the slits 30C'. The electroconductive member 32 slightly sticks out from the edge of the guide so as to cover comb-like structures 30A' of the exit-side guide member 30' (L3 is FIG. 7A). The electroconductive member 32 is earthed as is in FIG. 5B.

In this embodiment, as shown in FIG. 7B, a toner accumulating on the comb-like structures 30A' and the slits 30C' is attracted and collected by the electroconductive member 32. Therefore, a toner adhering again to the backside of a transfer paper contacting the guide face 30B' and the edge is reduced to prevent the backside contamination of a transfer paper.

Figure 8A:
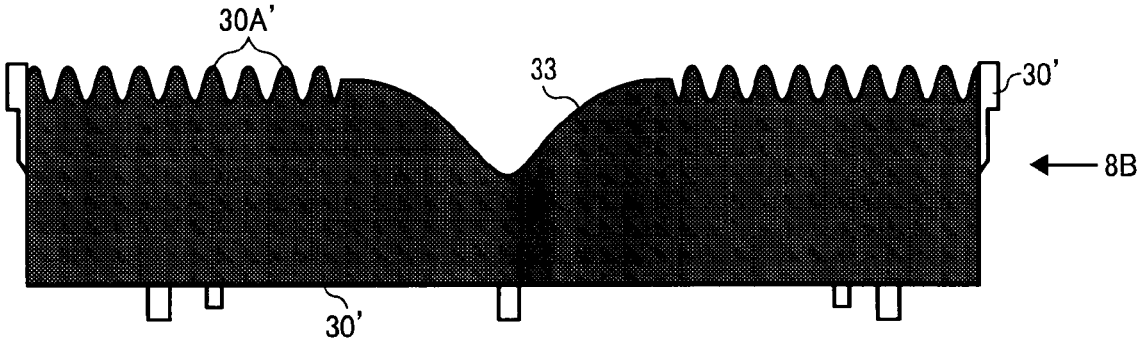
FIGS. 8A and 8B are schematic views illustrating another embodiment of the feeder in FIGS. 5A, 5B, 5C and 5D.
Figure 8B:
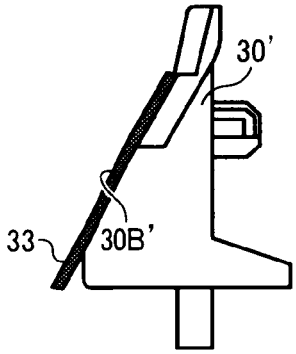

The exit-side guide member 30', as shown in FIG. 8, has the guide face 30B' an electric-resistive sheet 33 is formed on. In FIG. 8, the electric-resistive sheet 33 is attached to the guide face 30B' of the exit-side guide member 30' so as to cover almost all the area in the width and feeding directions of a transfer paper. The sheet 33 prevents a toner from being charged by friction with a transfer paper traveling the surface of the sheet to prevent the charged toner from scattering and image distortion due to abnormal contact charging. Hereinafter, toner scattering will be explained.

A transfer paper traveling through the transfer guide is occasionally friction-charged when contacting the guide member. When the transfer paper is charged, a toner is unexpectedly charged, resulting in toner image distortion and inner contamination of the image forming apparatus due to toner scattering.

As disclosed in Japanese published unexamined application No. 2007-292904, the transfer guide conventionally has a discharger.

Plural ribs are formed in the width direction of a transfer material perpendicular to the feeding direction thereof such that the center is higher than both ends.

The center of the transfer material in the width direction thereof restores to the status quo, i.e., horizontal status with a force of restitution of itself (stiffness) and a contact force of the transfer material to the ribs at the center in the width direction is decreased so as not to be easily charged.

However, the transfer material has to contact the ribs, and as shown in Japanese published unexamined application No. 2007-292904, the transfer material is inevitably friction-charged when contacting them. Therefore, a toner just electrostatically adhering to the transfer material changes in its charged status, which possibly causes image distortion and toner scattering.

In this embodiment, the sheet 33 has low electrical resistivity to inhibit a transfer paper traveling on the surface thereof from being frictionally charged.

When the sheet 33 has low electrical resistivity, the sheet is instantly discharged even if frictionally charged, which prevents repulsion of a frictionally-charged toner and scattering thereof. Further, a discharger applying a DC or an AC bias to the backside of a transfer material at an exit thereof is not needed, and a low-cost discharging function can be performed.

Figure 9A:
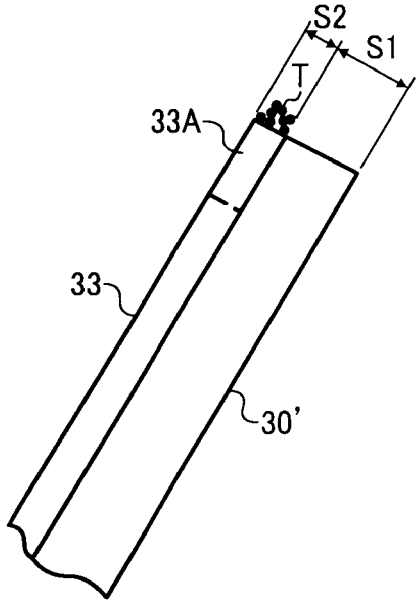
FIGS. 9A and 9B are schematic views for explaining the operation of the feeder in FIGS. 8A and 8B.

As shown in FIG. 9, the sheet 33 has a comb-like structure 33A having a thickness less than 0.3 mm as the exit-side guide member 30' does. This is because the edge area accumulating a toner can be smaller as the thickness become thinner. FIG. 9A shows a sheet used for lowering the friction coefficient against a transfer paper. The sheet has a thickness of approximately 2 mm in consideration of durability of a transfer paper when the end thereof hits the sheet. The sheet 33 is preferably formed of a fluorine-containing resin such as PTFE (polytetrafluoroethylene) and preferably has a resistivity not greater than 40Ω.

In this embodiment, the sheet 33 has a thickness of 0.2 mm. The edges of the sheet 33 and the exit-side guide member 30' meet each other. Alternatively, one of the sheet 33 and the exit-side guide member 30' sticks out from the other.

Figure 9B:
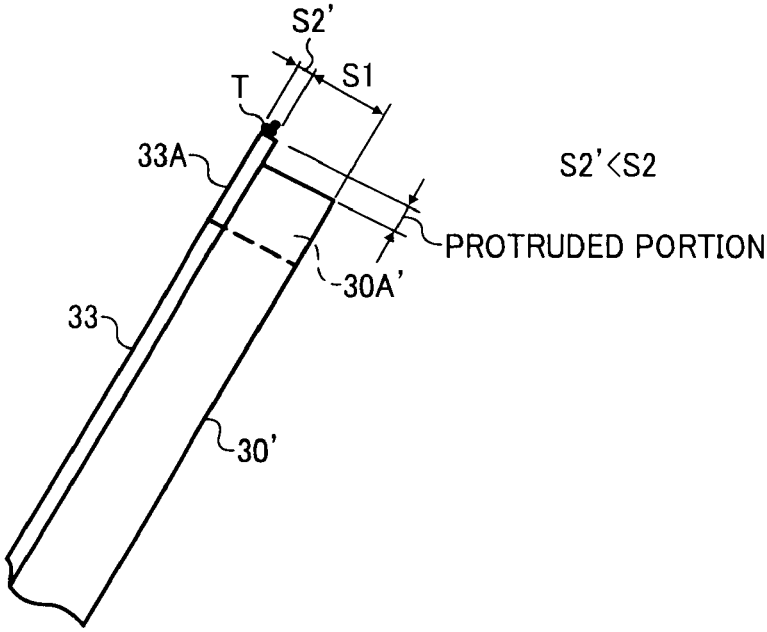

FIGS. 9A and 9B shows a facing relation between the edges of the sheet 33 and the exit-side guide member 30'.

FIG. 9A shows that the edges of the sheet 33 and the exit-side guide member 30' meet each other. FIG. 9B shows that the sheet 33 sticks out from the exit-side guide member 30'. In addition, the exit-side guide member 30' may stick out from the sheet 33.

The sheet 33 has the comb-like structure 33A, and the exit-side guide member 30' may have a comb-like structure 30A' (FIG. 9B) or not (FIG. 9A).

In whichever way, the sheet 33 has the comb-like structure 33A at the edge and a small contact area with the backside of a transfer paper.

In FIG. 9A, a toner dragged by a transfer paper passing the guide face 30B' accumulates at the edge of the sheet 33 not at the edge of the exit-side guide member 30'. However, the edge of the sheet 33 has such a small area that a toner does not accumulate at the edge thereof. Therefore, possibility of the backside contamination of a transfer paper is extremely reduced.

When the edges of the sheet 33 and the exit-side guide member 30' meet each other, the sheet 33 can easily be positioned against the exit-side guide member 30'.

The sheet 33 may have slits facing the slits 30C' of the exit-side guide member 30' in FIG. 6, which increases the collection efficiency of a toner from a transfer paper passing the guide face 30B'.

The sheet 33 not only has a low electrical resistivity but also can electrically be floated, which prevents a toner included in an image from being quickly discharged and scattering, different from being earthed.

The present invention includes three cases where only the exit-side guide member 30' has an edge having a comb-like structure 30A', the exit-side guide member 30' and the sheet 33 thereon have edges having comb-like structures 30A' and 33A, respectively, and only the sheet 33 has a comb-like structure 33A.

When only the sheet 33 has a comb-like structure 33A, the edge of the sheet 33 sticks out from the edge of the exit-side guide member 30' to make the comb-like structure 33A effective.

Since the exit-side guide member 30' has the shape of a plate, i.e., is formed a flat member, the sheet 33 is easily attached to the surface thereof. Namely, when the guide face has convexities and concavities, a sheet is very difficult to attach thereto.

As mentioned above, a toner adhering to the backside of a transfer paper passing the guide face 30B' of the exit-side guide member 30' is collected and it prevents the collected toner from adhering again to the backside of a transfer paper. Constitutions for a transfer paper to avoid contacting the exit-side guide member 30', particularly the edge thereof include FIGS. 10 and 11.

Figure 10:
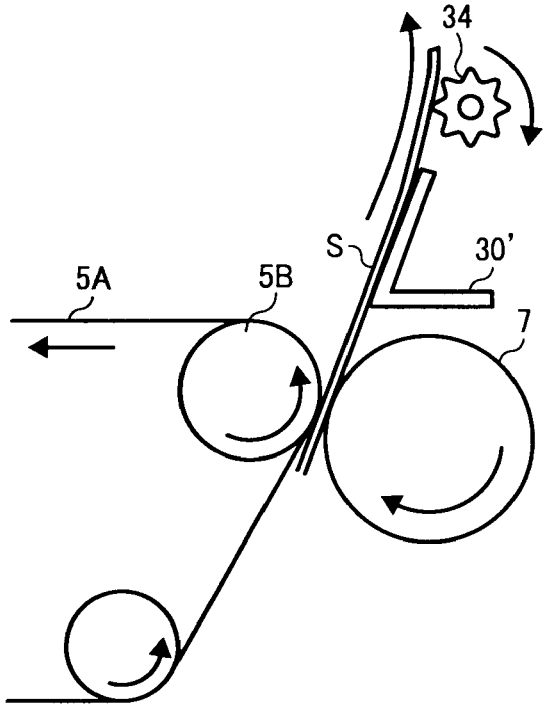
FIG. 10 is a schematic view illustrating another embodiment of the transferee of the present invention.

In FIG. 10, a spur 34 is located in a route of the transfer paper exit side of the exit-side guide member 30', which floats a transfer paper having passed the exit-side guide member 30' to prevent a toner being dragged by and accumulated at the edge of the exit-side guide member 30'.

Figure 11:
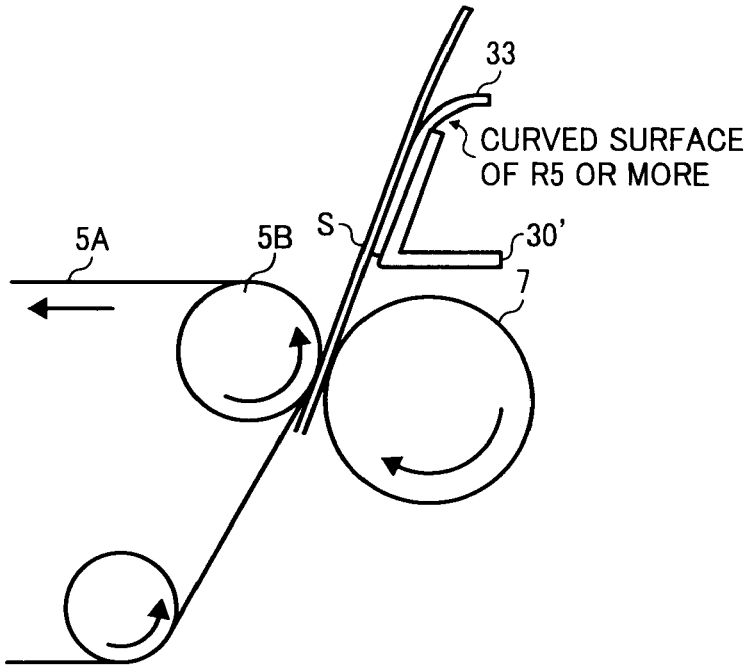
FIG. 11 is a schematic view illustrating a further embodiment of the transferee of the present invention.
Figure 12A:
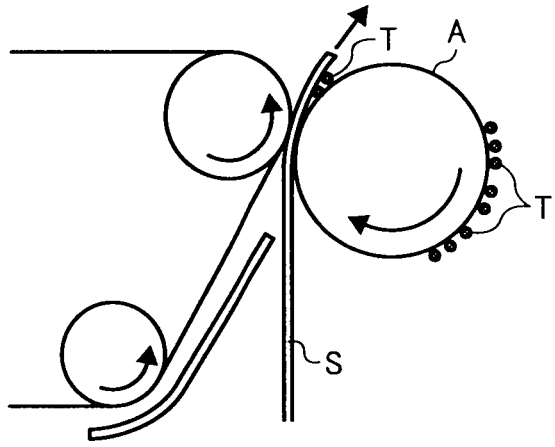
FIGS. 12A and 12B are schematic views for explaining the reason for the backside contamination of a transfer material with a toner.
Figure 12B:
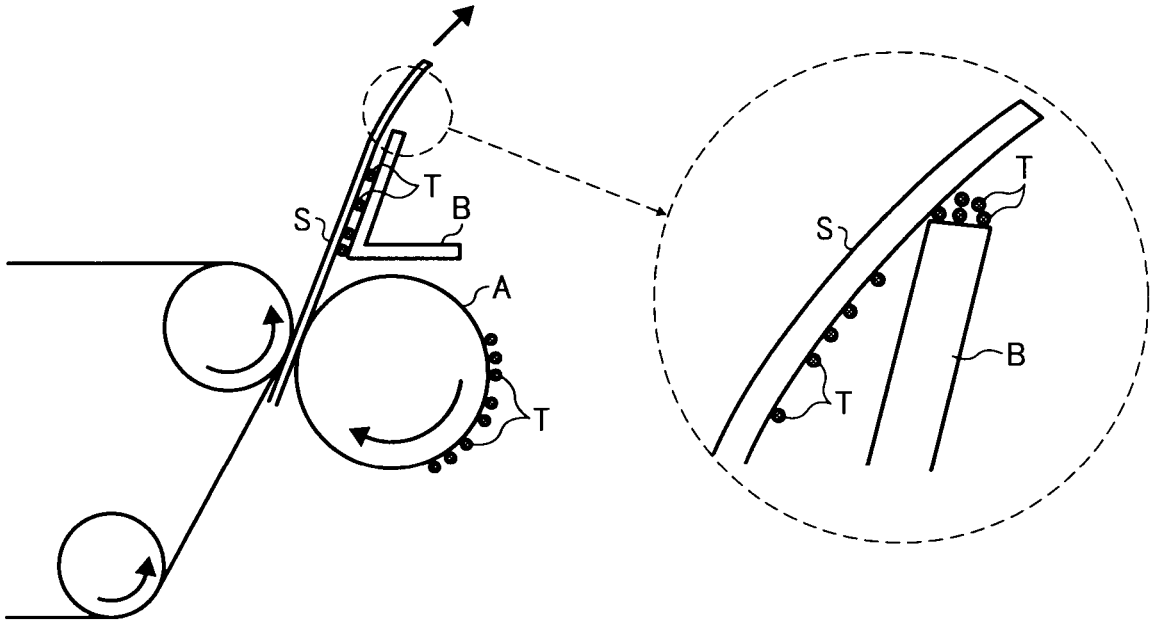
Figure 13A:
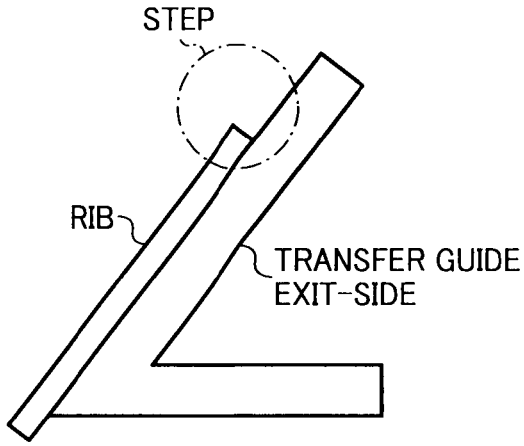
FIGS. 13A and 13B are schematic views illustrating an experiment of the backside contamination and its result using a conventional technology.
Figure 13B:
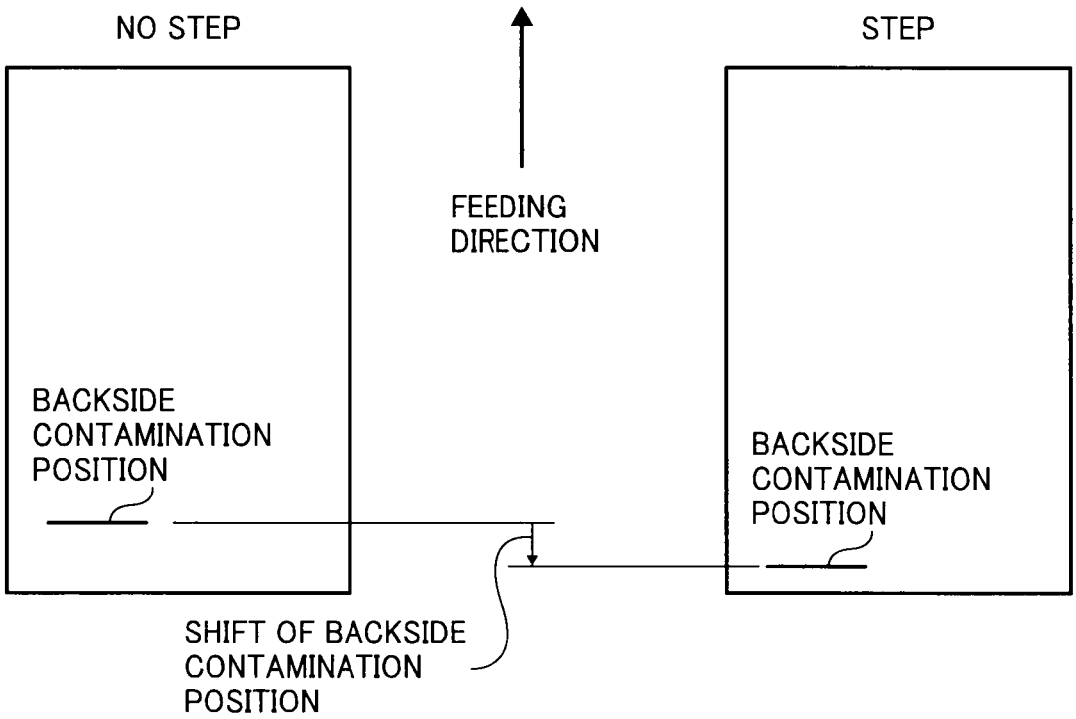

In FIG. 11, the sheet 33 shown in FIGS. 8 and 9 is extended so as to curve toward a direction leaving from the feeding route at a curvature radius of approximately 5 mm from the edge of the exit-side guide member 30'. A toner dragged by a transfer paper does not reach the edge thereof and does not accumulate thereat, which prevents the backside contamination of a transfer paper.

In the present invention performing vertical transfer, a transfer guide located between the second transfer position and the fixer 19 is featured.

When a transfer paper having passed the transfer position is unstably transferred, the transfer paper has a wrinkle when passing a fixing nip, resulting in defective images.

As disclosed in Japanese published unexamined applications Nos. 09-188439 and 11-172972, the transfer nip of the second transferee and the fixing nip of the fixer are located on a direct line, specifically almost at the same position, in the vertical or horizontal direction in many cases.

Particularly, as disclosed in Japanese published unexamined application No. 11-172972, in the vertical transfer method vertically transferring a transfer paper from the second transfer position to the fixer, a transfer paper let out from the transfer nip is forcibly reversed to the fixing nip in some cases. The transfer guide continuously has a transfer exit side and a fixing entrance side like mirror writing as shown in FIG. 4A in many cases.

The transfer roller and the transfer belt contact each other at the transfer nip, and when a transfer paper travels along a curvature radius of the transfer roller, the transfer paper is occasionally curled from the end. The end of the transfer paper travels hitting the guide member guiding the transfer paper to a direction reverse to the curl direction. Since the end of the transfer paper does not have a shape according to a guide face of the guide member, the transfer paper reaches the fixing nip floating from (not along) the guide member due to resistivity caused by being scraped, resulting in distorted fixed images, i.e., abnormal images such as wrinkled images.

Figure 4A:
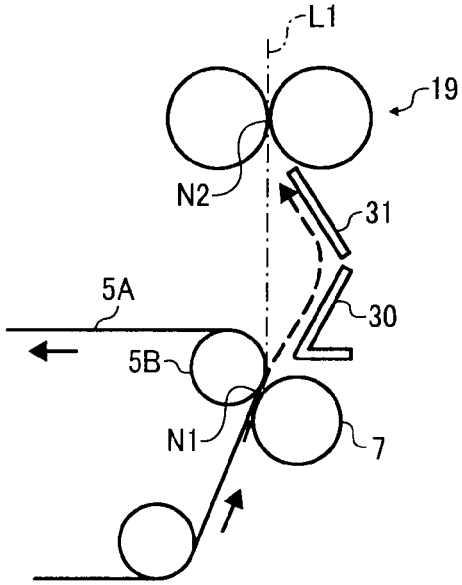
FIGS. 4A, 4B and 4C are schematic views for explaining comparison between a feeding guide for use in the transferee of the present invention and a conventional feeding guide.
Figure 4B:
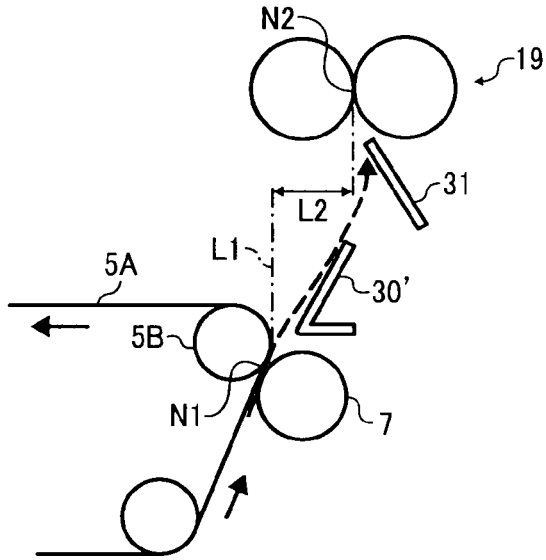
Figure 4C:
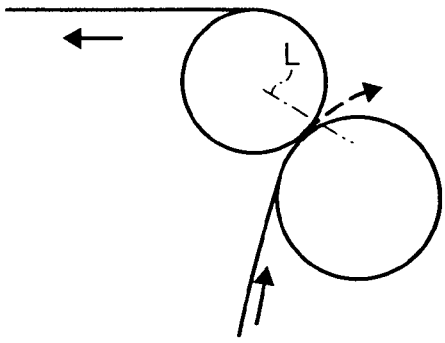

In FIG. 4C, in the traveling direction (indicated by an arrow) of the intermediate transfer belt 5A, the second transfer roller 7 is located at an upstream side of a normal line L from the drive roller 5B at a position where the intermediate transfer belt 5A is wound thereby. This is because a circumferential length of the transfer paper S against the second transfer roller 7 is extended so as to prolong a bias period thereto for increasing the transfer efficiency.

A positional relation between a transfer nip N1 formed by the drive roller 5B and the second transfer roller 7 and a fixing nip N2 formed by the heat roller and pressure roller of the fixer is conventionally almost same in the vertical direction (same on a line indicated by L1 in FIG. 4A) as shown in FIG. 4A equivalent to Japanese published unexamined application No. 2007-292904. In the transfer route between the nips, the exit-side guide member 30 and the fixing entrance-side guide member 31 are continuously located to forcibly reverse a transfer paper let out from the transfer nip N1 to the fixing nip N2.

However, as shown in FIG. 4C, since the intermediate transfer belt 5A is pressed by the second transfer roller 7, a transfer paper S passing the transfer nip is likely to be curled from the end along the circumferential surface of the second transfer roller 7. Therefore, a curled transfer paper S having passed the transfer nip N1 travels to the fixing nip N2 while scraped by the exit-side guide member 30 guiding the transfer paper S to a direction reverse to the curl direction and the fixing entrance-side guide member 31. Consequently, the transfer paper is difficult to unstably travel along the guide due to resistivity caused by contacting the guide member, and the resultant fixed images are likely to have wrinkles or distortions.

In this embodiment, The fixing nip N2 is located above on the opposite side of the intermediate transferer of the transfer nip N1 (L2 in FIG. 4B). The opposite side is an opposite side of a range occupied by the intermediate transferer which is one of image bearers, i.e., an opposite side of a side where the intermediate transferer is located sandwiching the transfer route of a transfer material as shown in FIG. 4B. The above means the above of the opposite side of the intermediate transferee. Therefore, a deflection of a transfer paper S after entering the fixing nip is steadily directed to the transfer exit-side guide member 30'.

The fixing entrance-side guide member 31 is independently and separately located from the transfer exit-side guide member 30' to hold the deflection of a transfer paper S after entering the fixing nip N2. Therefore, a transfer paper is likely to travel along the guide and the deflection is directed to the guide, and the transfer paper is stably transferred to prevent wrinkles and image distortion when images are fixed.

In the present invention, as mentioned above, when the fixing nip N is located above on the opposite side of the intermediate transferer against the transfer nip N1, a transfer paper is transferred along the transfer exit-side guide member 30'. A transfer paper contacts the edge of the transfer exit-side guide member 30' as shown in FIG. 4B more steadily than the conventional case in FIG. 4A. Namely, a toner accumulating at the edge of the transfer exit-side guide member 30' is likely to contaminate the backside of a transfer paper. The transfer exit-side guide member 30' of the present invention, used in such a fixer prevents wrinkles and image distortion when images are fixed, and at the same time, prevents the backside contamination of a transfer paper.

This application claims priority and contains subject matter related to Japanese Patent Application No. 2008-122482 filed on May 8, 2008, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A transferer, comprising:

a guide member having a plate-shaped guide face, configured to lead a transfer material after a toner is transferred thereonto, wherein the guide member has an edge pointing to the feeding direction of the transfer material, the edge including plural comb-like structures arranged perpendicular to the feeding direction, and wherein the guide member includes a guide face and an electric-resistive sheet attached thereto.

2. The transferer of claim 1, wherein each of the comb-like structures has a thinner width in a direction perpendicular to the feeding direction of the transfer material from upstream to downstream.

3. The transferer of claim 1, wherein the guide member has at least an electroconductive member facing the comb-like structures on the backside of the guide face.

4. The transferer of claim 3, wherein the electroconductive member extends beyond the edge of the guide member in the feeding direction of the transfer material.

5. The transferer of claim 3, wherein the electroconductive member is located facing the comb-like structures and slits provided with the guide member.

6. The transferer of claim 1, wherein the guide member has slits spaced apart from the plural comb-like structures.

7. An image forming apparatus, comprising:

an image bearer configured to bear an image;

the transferer according to claim 1, further comprising a transfer nip, configured to transfer a toner image formed on the image bearer onto a transfer material;

a fixer comprising a fixing nip configured to fix the toner image on the transfer material; and a feeding route configured to vertically feed the transfer material from the transfer nip and the fixing nip, wherein the fixing nip is located above on the opposite side of the image bearer from the transfer nip.

8. The transferer of claim 1, wherein the electric-resistive sheet covers almost all of an area of the guide face in a width direction and a feed direction of a transfer paper.

9. The transferer of claim 1, wherein the sheet has a thickness of less than 0.3 mm.

10. The transferer of claim 1, wherein the sheet is formed of a fluorine-containing resin.

11. The transferer of claim 1, wherein the sheet has a resistivity not greater than 400.

12. The transferer of claim 1, wherein the edge of the guide member sticks out from an edge of the electric-resistive sheet in the feeding direction.

13. The transferer of claim 1, wherein the guide member has a shape of a plate.

14. The transferer of claim 6, wherein at least one of the slits is positioned along the guide face upstream in the feeding direction from the comb-like structures.

* * * * *